US007677567B2

(12) United States Patent
Chen

(10) Patent No.: US 7,677,567 B2
(45) Date of Patent: Mar. 16, 2010

(54) CUBIC ASSEMBLY PUZZLE AND SUPPORT STRUCTURE

(76) Inventor: Ronghao Chen, 61 Windsor Pond Rd., West Windsor, NJ (US) 08550-3278

( * ) Notice: Subject to any disclaimer, the term of this patent is extended or adjusted under 35 U.S.C. 154(b) by 406 days.

(21) Appl. No.: 11/562,609

(22) Filed: Nov. 22, 2006

(65) Prior Publication Data

US 2008/0116633 A1 May 22, 2008

Related U.S. Application Data

(62) Division of application No. 10/919,533, filed on Aug. 16, 2004, now Pat. No. 7,140,612.

(51) Int. Cl.
*A63F 9/12* (2006.01)

(52) U.S. Cl. ..... 273/157 R; 273/156

(58) Field of Classification Search ..... 273/156, 273/157 R, 160; 446/117, 118
See application file for complete search history.

(56) References Cited

U.S. PATENT DOCUMENTS 1,100,828 A * 6/1914 Heard ..... 273/160
2,900,290 A 8/1959 Pestieaau
3,065,970 A 11/1962 Besley
3,410,021 A * 11/1968 Patterson ..... 446/78
3,638,949 A * 2/1972 Thompson ..... 273/157 R
3,672,681 A * 6/1972 Wolf ..... 273/157 R
3,771,795 A 11/1973 Flanigen
3,964,749 A 6/1976 Wadsworth
3,993,313 A * 11/1976 Tillotson ..... 273/282.1
4,063,736 A 12/1977 Robinson
4,153,254 A 5/1979 Marc
4,210,332 A * 7/1980 Shanin ..... 273/157 R
4,257,609 A 3/1981 Squibbs
4,534,563 A 8/1985 Guenther
4,551,110 A * 11/1985 Selvage et al. ..... 446/118
4,662,638 A 5/1987 Vachek
4,696,476 A 9/1987 Eplett
4,699,602 A 10/1987 Giorgi
D298,149 S 10/1988 Hermans et al.
4,784,392 A 11/1988 Johnson
4,844,466 A 7/1989 Johnson et al.
4,874,176 A * 10/1989 Auerbach ..... 273/157 R
5,393,063 A 2/1995 Ichimaru
5,785,319 A * 7/1998 Frauhiger ..... 273/157 R
5,823,533 A * 10/1998 Edwards ..... 273/160
5,868,388 A 2/1999 Wood et al.
6,029,974 A * 2/2000 Povitz ..... 273/157 R
6,196,544 B1 * 3/2001 Rachofsky ..... 273/157 R
6,220,919 B1 * 4/2001 Cheng ..... 446/117
6,648,330 B2 11/2003 Porter (Continued)

FOREIGN PATENT DOCUMENTS

CH 639288 A5 * 11/1983

(Continued)

*Primary Examiner*—Steven Wong
(74) *Attorney, Agent, or Firm*—Altimatia, LLC; David M. Gange

(57) ABSTRACT

A game or puzzle including a plurality of polyomino assembly pieces and a support base. The support base aids the user in visualizing the shape of the puzzle to be assembled and provides support to the assembly pieces during puzzle assembly.

5 Claims, 19 Drawing Sheets

U.S. PATENT DOCUMENTS

| | | | | |
|---|---|---|---|---|
| 6,666,453 | B2 | 12/2003 | Chambers | |
| 6,692,001 | B2 * | 2/2004 | Romano | 273/157 A |
| 6,702,285 | B2 * | 3/2004 | Cheng | 273/153 R |
| 2002/0121739 | A1 | 9/2002 | Sum | |
| 2004/0063080 | A1 | 4/2004 | Cheng | |

FOREIGN PATENT DOCUMENTS

| | | | |
|---|---|---|---|
| GB | 2183166 A | * | 6/1987 |
| GB | 2237517 A | * | 5/1991 |

* cited by examiner

TOP LAYER

BOTTOM LAYER

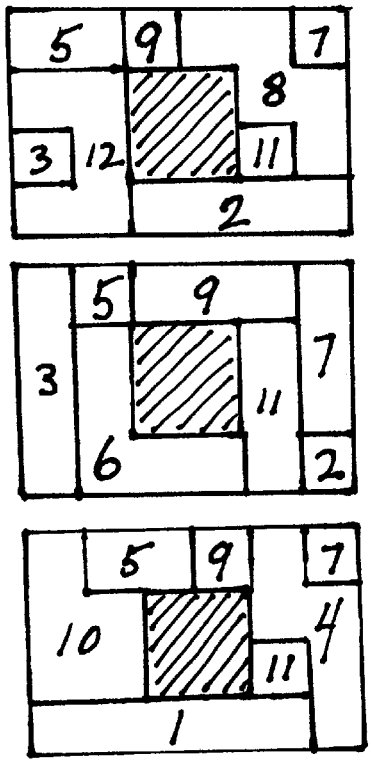
Fig. 9A
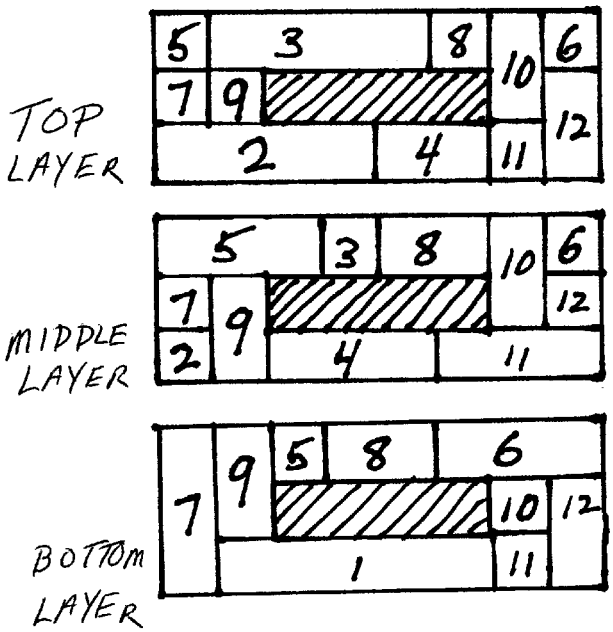
Fig. 9B
Fig. 9C
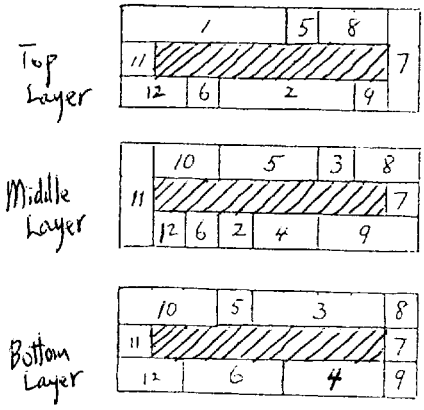

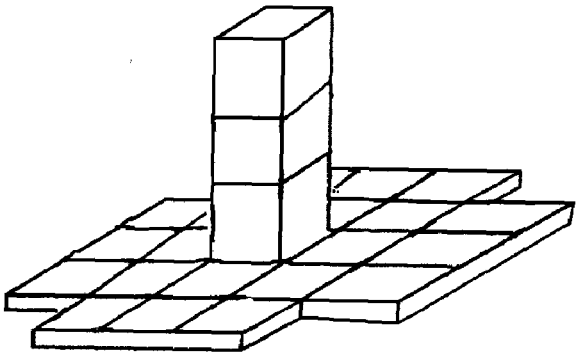
Fig. 10A
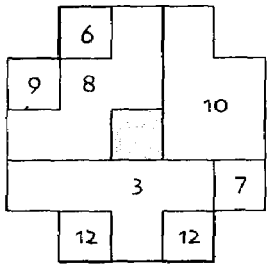
Top Layer
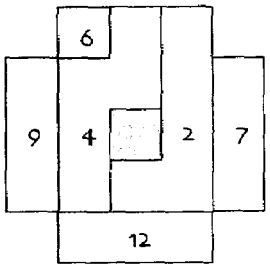
Middle Layer
Fig. 10B
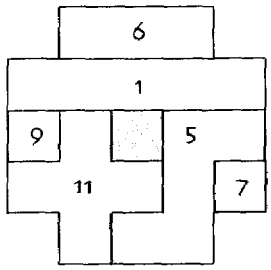
Bottom Layer

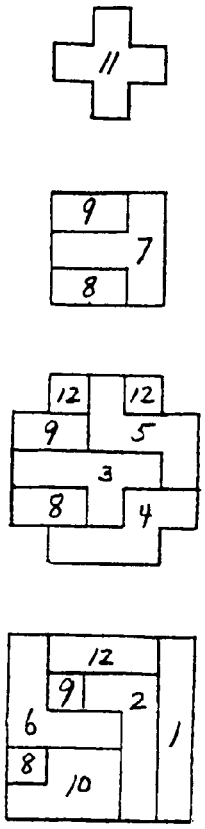
BOTTOM LAYER
2ND LAYER
3RD LAYER
TOP LAYER
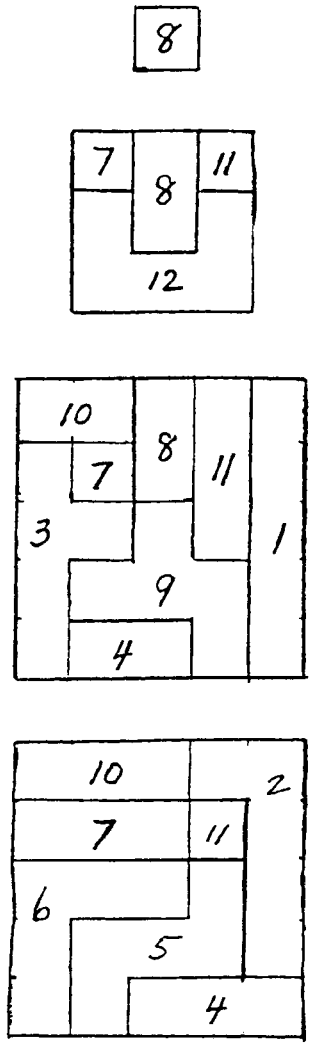
Fig. 17A
Fig. 17B

CUBIC ASSEMBLY PUZZLE AND SUPPORT STRUCTURE

CROSS REFERENCE TO RELATED APPLICATIONS

This application claims the benefit of U.S. patent application Ser. No. 10/919,533 filed Aug. 16, 2004 now U.S. Pat. No. 7,140,612 which is hereby incorporated herein by reference in its entirety.

BACKGROUND OF THE INVENTION

The present invention relates to the field of games and puzzles. More particularly, the invention relates to puzzles composed of multiple pieces that are to be assembled to form predefined shapes.

There are many puzzles available that require a particular order of assembly to achieve completion of the puzzle. Some require an arrangement of pre-connected pieces in a particular order. Colors or pictures may be interposed on certain surfaces of the puzzles. Many puzzles have been available for years and solutions are well known. The entertainment and education provided by these puzzles diminishes as they are solved by an individual on multiple occasions. Memorization of solutions leads to a diminishing of the puzzle challenge. Dedicated puzzle solvers require new challenges to their intellectual prowess. Therefore there is a need for an inventive puzzle that provides new challenges and entertainment for the puzzle solving public.

Pentomino and polyomino puzzles are known. A pentomino puzzle comprising a rectangular board or holder and flat pieces disclosed in both the 1959 U.S. Pat. No. 2,900,190 to Pestieau and the 1988 U.S. Pat. No. D298,149 to Hermans, et al. The 1999 U.S. Pat. No. 5,868,388 to Wood, et al describes an eight by eight square puzzle frame for holding colored cubic pentomino and tetromino pieces in a chess or checkerboard type array. The 1976 U.S. Pat. No. 3,964,749 to Wadsworth describes a board containing four rectangular playing areas, with each area comprising ninety square units, to be used with eighteen flat pentominos. A puzzle comprising a base and a mixture of flat tri, tetra, hexa, and hepta-polyomino pieces is described in the 2003 U.S. Pat. No. 6,666,453. Cheng describes a puzzle in the 2001 U.S. Pat. No. 6,220,919, where the puzzle comprises a base with round indentations and mono, tri, tetra, penta, and hexa-omino puzzle pieces made from spheres instead of cubes. Another patent to Cheng, the 2004 U.S. Pat. No. 6,702,285, describes using a frame to hold polyomino puzzle pieces in a vertical configuration, one cube in thickness.

The puzzles in the patents cited above are assembled to form simple, flat square or flat rectangular shapes. Polyominos may be constructed of cubes instead of flat squares and cubic polyomino puzzles may be assembled into both two dimensional as well as three dimensional puzzles. Three dimensional polyomino puzzles possess added complexity and challenge for the user. Polyomino puzzles assembled to form simple three dimensional cubic and rectangular parallelepiped shapes are described in the 1962 U.S. Pat. No. 3,085,970 to Besley, the 1989 U.S. Pat. No. 4,844,466 to Johnson, et al, the 1998 U.S. Pat. No. 5,823,533 to Edwards, the 1999 U.S. Pat. No. 5,868,388 to Wood et al, the 2001 U.S. Pat. No. 6,220,919 to Cheng, and the 2004 U.S. Pat. No. 6,702,285 to Cheng.

In addition to flat square and rectangular shapes and three-dimensional cubic and rectangular parallelepiped shapes, polyominos can be assembled into a variety of interesting three dimensional symmetrical figures. While many unique figures can be formed, assembly of the figures is problematic. Puzzle users may have difficulty visualizing the complex figure to be formed and there is also tendency for the blocks to fall during assembly A combination of polyomino blocks and a three-dimensional support base, which aids in visualization and provides support to the blocks during assembly, eliminates the problems thereby increasing the users' enjoyment of the puzzle.

SUMMARY OF THE INVENTION

It is an object of the invention to provide a puzzle forming a three-dimensional symmetrical figure comprising support bases and a set of intermitting assembly pieces such that the puzzles may be assembled in a multitude of ways. It is another object of the invention to provide polyomino assembly pieces, particularly polyominos having shapes equivalent to unit cubes facially attached to one another wherein the number of cubes used to form individual pieces is in the range of one to eight. Preferably the assembly pieces of the invention are twelve pentominos having a shape equivalent to five cubes attached facially, such that all the centers of all of the cubes lie in a single plane.

It is a further object of the invention to provide support bases for supporting the assembly pieces during puzzle assembly. The support bases of the invention comprise a polygonal bottom member with either vertical side walls or vertical towers or both attached to the bottom member. The support bases of the invention may optionally include slidingly removable side walls. Preferably the removable side walls are attached to one another so as to form a sleeve which may be slidingly removed from the support base in either a vertical or horizontal direction. The vertical towers have a shape equivalent to a whole number of cubes of the same dimension as the cubes forming the assembly pieces. The bottom members and vertical side walls have a shape divisible into a whole number of squares, where the size of a square is equal to the size of a cube face.

The objects of the invention can be made of any material such as plastic, wood, metal, stone, mineral, paper, cardboard, fabric or other suitable material. The support bases, side walls, and assembly pieces of the invention may be colored uniformly or differently. Individual cube portions of the assembly pieces may be colored differently so as to form an aesthetically pleasing pattern or picture upon puzzle assembly. Numbers may be placed upon the cube-portion faces so as to form particular numeric totals vertically, horizontally, and diagonally upon puzzle assembly. It is a further object of the invention to provide packaging and written directions for use of puzzles of the invention.

BRIEF DESCRIPTION OF THE DRAWINGS

Extra lines have been added to the drawings of the support bases and assembly pieces (FIGS. 1, 2, 4, 6, 8, 10A, 11, 15, 16) in order to more clearly indicate the dimensions of the objects. The numbers shown within the drawings displaying solutions to puzzles (FIGS. 3, 5, 7, 9, 10B, 12, 13, 14, 17) refer to the numbered pieces displayed in FIG. 1. The dimensions of towers are described as length by width by height. A unit is equivalent to the length of an edge of a cube.

FIG. 9A shows a solution to a puzzle fitting the support base of FIG. 8A.

FIG. 9B shows a solution to a puzzle fitting the support base of FIG. 8B.

FIG. 9C shows a solution to a puzzle fitting the support base of FIG. 8C.

FIG. 10A shows a single-tower puzzle support base comprising a four-unit by four-unit bottom member from which each of the four, unit-square, corners has been removed thereby forming a plus-shaped bottom member and centrally located one-unit by one-unit by three-unit tower.

FIG. 10B shows a solution to a puzzle fitting the support base of FIG. 10A.

FIG. 17A shows a solution to a puzzle fitting the support base of FIG. 15.

FIG. 17B shows a solution to a puzzle fitting the support base of FIG. 16

DETAILED DESCRIPTION OF THE INVENTION

Figure 1:
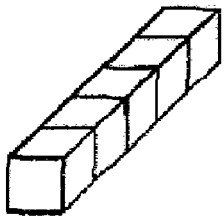
FIG. 1 shows twelve pentomino pieces used in constructing puzzles of the invention.

The puzzle assembly pieces of the embodiments of the invention are shown in FIG. 1. The puzzles described below comprise support bases and twelve assembly pieces, each piece having a shape equivalent to five facially-connected identical cubes such that the centers of all of the cubes lie in a common plane with common top and bottom surfaces. Facially connecting as used herein means that the connecting faces of the cubes are joined along their edges. The total volume of the assembly pieces used in the embodiments described below is sixty cubes. In the examples disclosed herein the assembly pieces have shapes equivalent to those formed from five cubes; however assembly pieces with shapes equivalent to those formed from other whole numbers of cubes, such as 1,2,3,4,6,7, or 8 are possible. The puzzles are solved by interfitting the assembly pieces and support bases to form three-dimensional symmetrical figures.

Figures 1, 2:
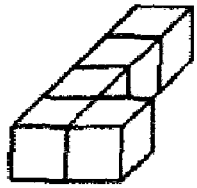

The assembly pieces are:

one piece (FIG. 1-1) having a shape equivalent to five adjacent cubes aligned in a row;

one piece (FIG. 1-2) having a shape equivalent to four cubes aligned in a row and a fifth cube connected to a side of an end cube in the row and the fifth cube being out of alignment with respect to the row;

one piece (FIG. 1-3) having a shape equivalent to four cubes in a row and a fifth cube connected to a side of an intermediate cube in the row;

one piece (FIG. 1-4) having a Z shape;

one piece (FIG. 1-5) having an S shape;

one piece (FIG. 1-6) having a V shape;

one piece (FIG. 1-7) having a T shape;

one piece (FIG. 1-8) having a W shape;

one piece (FIG. 1-9) having a shape equivalent to three cubes in a row with a fourth cube connected to a side of an intermediate cube in the row and a fifth cube connected to an opposite side of an end cube in the row which is opposite from the fourth cube;

one piece (FIG. 1-10) having a shape equivalent to four cubes that form a square and a fifth connected to one side of the four cube square;

one piece (FIG. 1-11) having a cross shape;

one piece (FIG. 1-12) having a U shape.

The assembly pieces, support bases, and side walls of the embodiments of the invention may be formed of any suitable material such as plastic, wood, metal, stone, mineral, glass, paper, cardboard, fabric or the like. The materials may be all the same color, or they may be colored differently. Assembly pieces may be uniform in color or individual cube portions may be colored differently, so as to form a pattern in the completed puzzle. Such patterns could include pictures, cube portions alternating in color to form a checkerboard pattern, cube portions alternating in color to form striped patterns, or other coloration patterns. In addition the faces of individual cube portions could display numbers, such that when assembled the numbers present on the cube portion faces add vertically, horizontally, and diagonally to form particular values. Colors may be a property of the materials, such as woods of differing colors (walnut, oak, maple), metals of differing colors (aluminum, copper, gold, silver), stone of differing colors (granite, pink marble, green marble, black marble, quartz), fabrics of different colors or patterns, or color may be a result of the application of a surface coating, such as paint or dye, to the material.

The bottom members of the embodiments of the invention disclosed herein are all flat and horizontally oriented. The upper surfaces of the bottom members, as well as the side walls, are divisible into a whole number of identically-sized, edge connected squares.

Figures 1, 2, 3:
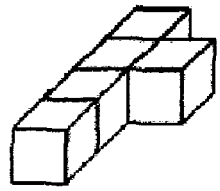
FIG. 3 shows one solution of a puzzle fitting the support base of FIG. 2.
Figures 1, 2, 3, 4:
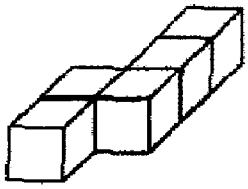
Figures 1, 2, 3, 4, 5:
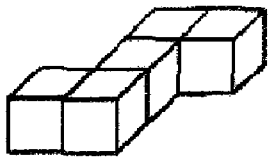
Figure 2B:
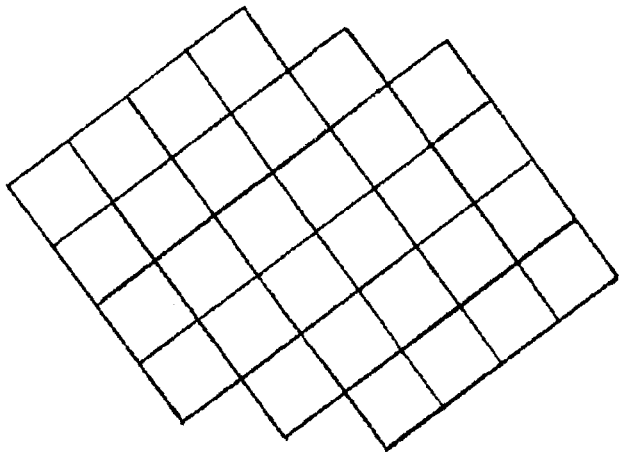
FIG. 2B shows the area of a treasure-box shaped puzzle bottom member divided into unit squares.
Figure 2A:
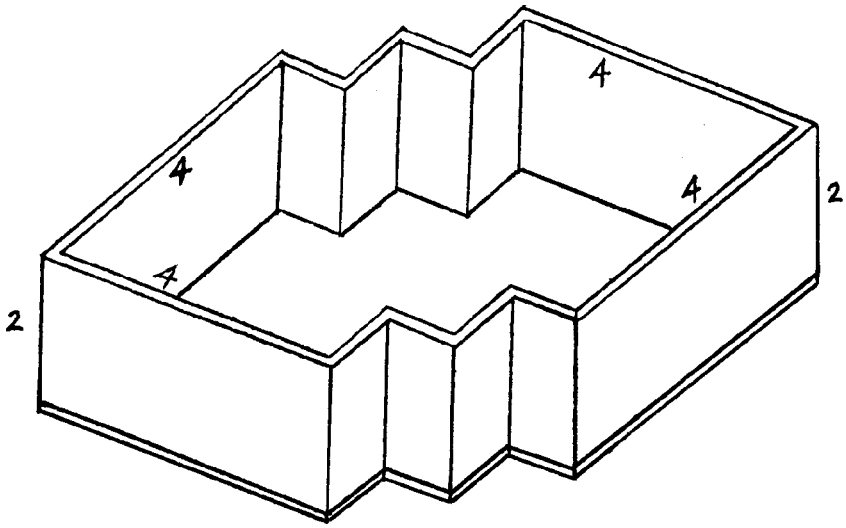
FIG. 2A shows a non-rectangular, treasure-box shaped, puzzle support base of the invention.
Figure 3A:
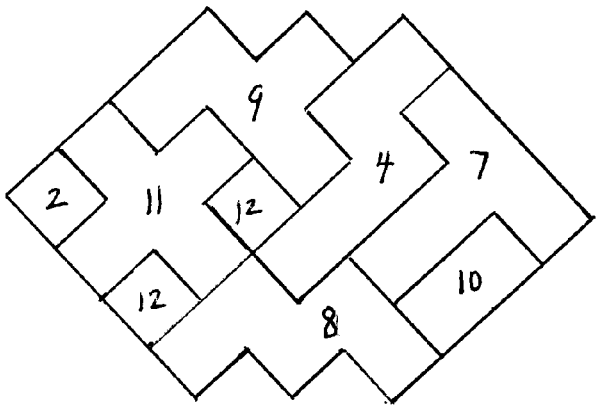
Figure 3B:
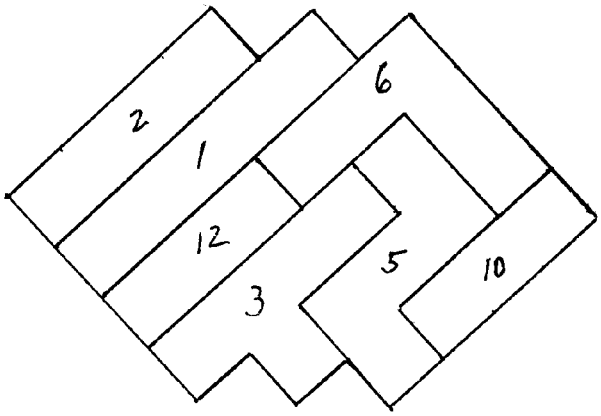

One embodiment of the invention comprises a bottom member to which is attached a circumferential side wall, two-units in height, as shown in FIG. 2A. The non-rectangular shape of the polygon described by the side wall is formed from a six-unit by six-unit square from which six-unit squares have been removed. Three unit squares are removed from each of two diagonally opposite corners of the square, the three squares being the corner unit square and the two facially adjoining squares. The final shape is called a treasure box shape. The twelve assembly pieces of the embodiment of the invention fit within the support base as shown in FIG. 3, occupying a total volume substantially equal to sixty cubes.

The following stairstep embodiments of the invention may optionally include horizontally slidingly removable sleeves, or sleeve-type walls, conforming to the stairstep shapes of the puzzles and useful for holding the pieces of solved puzzles in place. The puzzles are solved by fitting the assembly pieces such that a stairstep configuration, conforming to the stairstep side walls is formed. The volume occupied by a stair step puzzle is equal to the area of a stairstep side multiplied by the distance between the stairstep sides. The volume occupied by the stairstep figures of the following embodiments is substantially equal to sixty cubes.

Figure 4A:
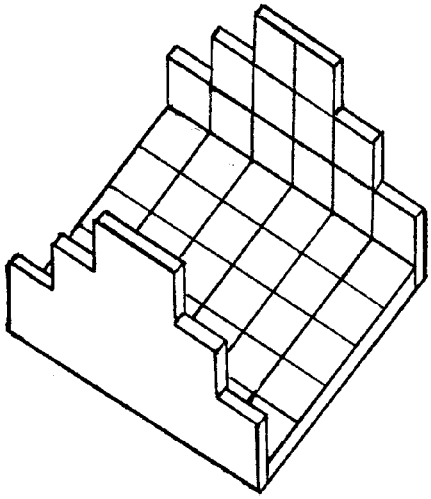
FIG. 4A shows a two-walled double-stairstep puzzle support base which is five-units wide, six-units deep, and three-units tall at the highest point.
Figure 5A:
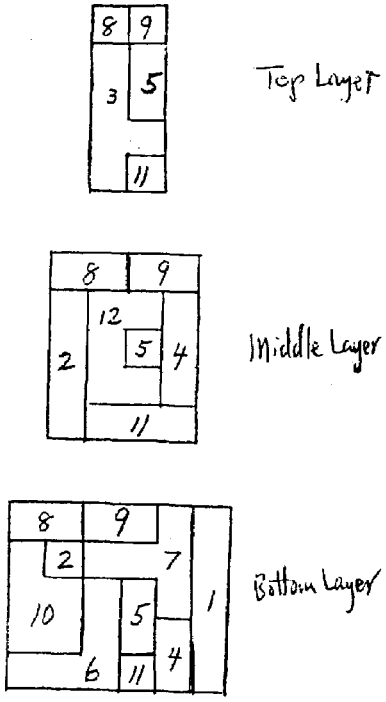
FIG. 5A shows a solution to a puzzle fitting the support base shown in FIG. 4A.

An embodiment of the invention is shown in FIG. 4A. The support base comprises a five-unit by six-unit rectangular bottom member. Attached to the two six-unit edges of the bottom member are two vertical side walls having a three-unit tall, three-level, double-stairstep shape. The side walls have a shape equivalent to a one-unit tall by six-unit wide foundation layer; a one-unit tall by four-unit wide middle layer attached above the foundation layer; and a one-unit tall by two-unit wide top layer attached above the middle layer; such that the midpoints of all three layers align. A solution is shown in FIG. 5A.

Figure 4B:
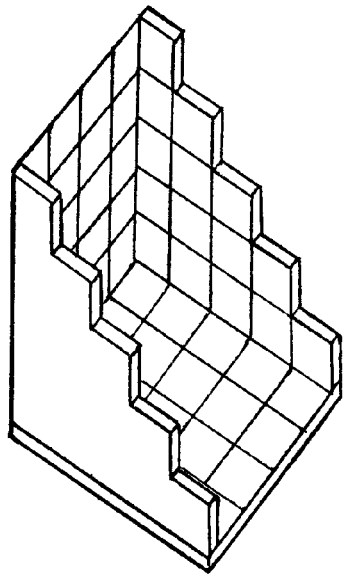
FIG. 4B shows a three-walled single-stairstep puzzle support base which is four-units wide, five-units deep, and five-units tall at the highest point.
Figure 5B:
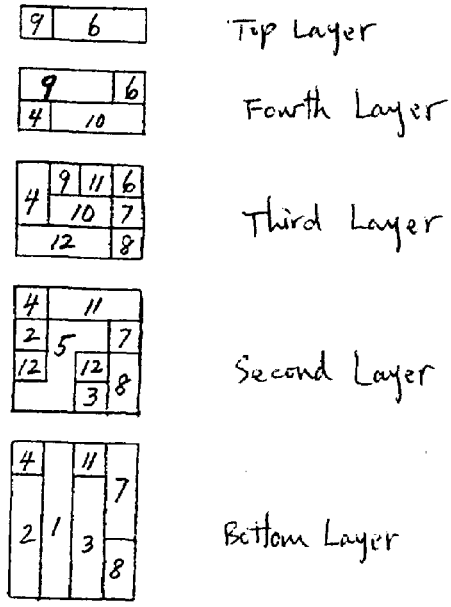
FIG. 5B shows a solution to a puzzle fitting the support base shown in FIG. 4B.

Another embodiment of the invention is shown in FIG. 4B. The support base comprises a four-unit by five-unit rectangular bottom member. A four-unit by five-unit rectangular vertical back member is attached to one of the four-unit bottom member edges. Two vertical stairstep side walls are attached to the two five-unit bottom member edges, as well as to the vertical edges of the back member. The side walls have a shape equivalent to a one-unit tall by five-unit wide foundation layer; a one-unit tall by four-unit wide layer above the foundation layer; a one-unit tall by three-unit wide layer above the four-unit wide layer; a one-unit tall by two-unit wide layer above the three-unit wide layer; and a one-unit tall by one-unit wide layer at the top; all of the layers being aligned to form a vertical edge, thereby forming a stairstep side wall. A solution is shown in FIG. 5B.

Figure 4C:
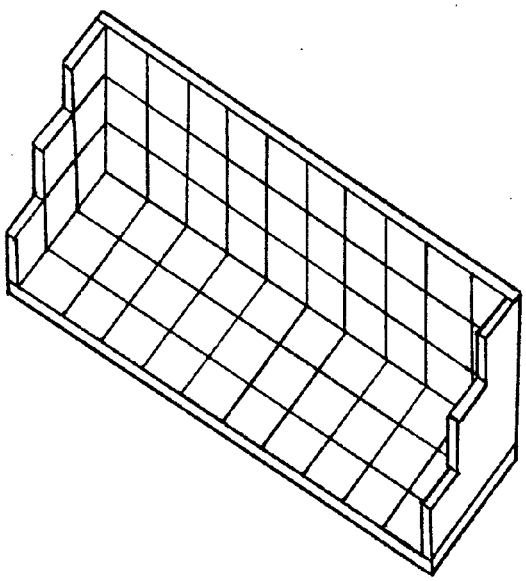
FIG. 4C shows a three-walled single-stairstep puzzle support base which is ten-units wide, three-units deep, and three-units tall at the highest point.
Figure 5C:
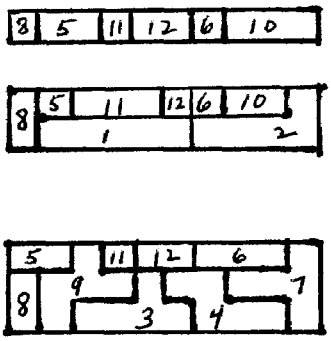
FIG. 5C shows a solution to a puzzle fitting the support base shown in FIG. 4C
Figure 6:
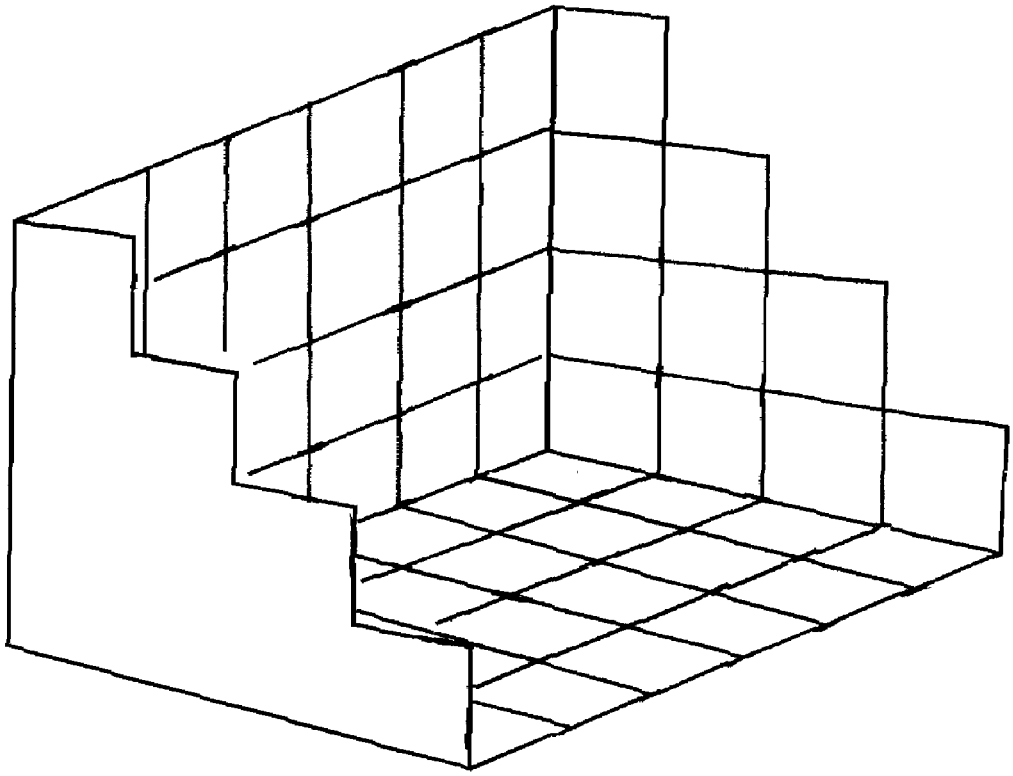
Figure 7:
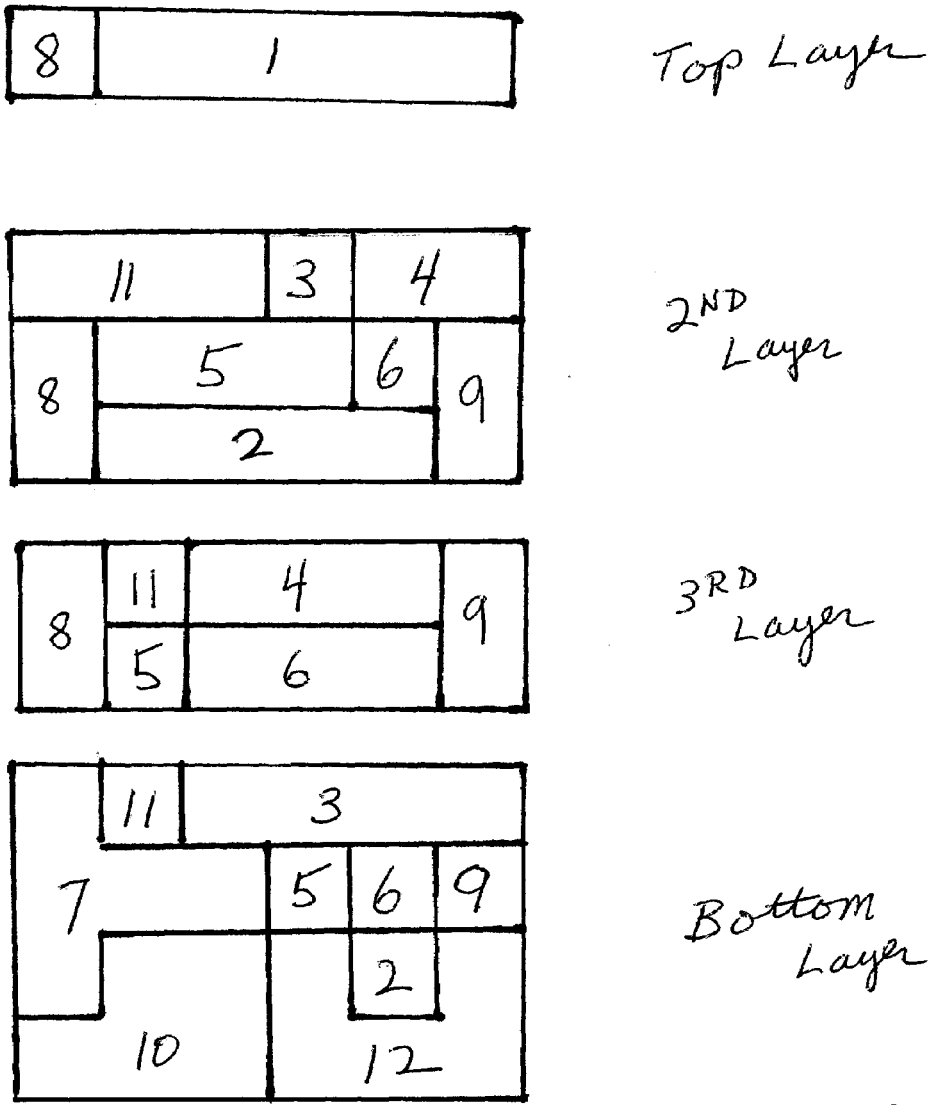

Another embodiment of the invention is shown in FIG. 4C. The support base comprises a three-unit by ten-unit rectangular bottom member. A three-unit by ten-unit rectangular vertical back member is attached to one of the ten-unit bottom member edges. Two vertical stairstep side walls are attached to the two three-unit bottom member edges as well as to the vertical edges of the back member. The side walls have a shape equivalent to a one-unit tall by three-unit wide foundation layer; a one-unit tall by two-unit wide layer above the foundation layer; and a one-unit tall by one-unit wide layer at the top; all of the layers being aligned to form a vertical edge, thereby forming a stairstep side wall. A solution is shown in FIG. 5C.

Figures 1, 2, 3, 4, 5, 6:
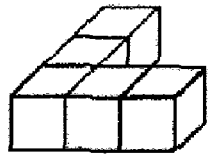
FIG. 6 shows a three-walled single-stairstep puzzle support base which is six-units wide, four-units deep, and four-units tall at the highest point.
Figures 1, 2, 3, 4, 5, 6, 7:
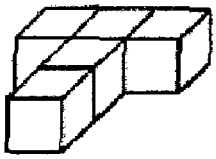
FIG. 7 shows a solution to a puzzle fitting the support base of FIG. 6.
Figures 1, 2, 3, 4, 5, 6, 7, 8:
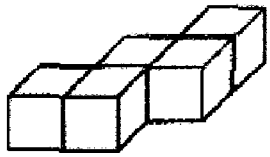
Figures 1, 2, 3, 4, 5, 6, 7, 8, 9:
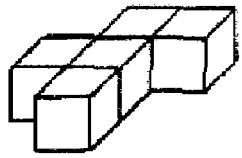
Figures 1, 2, 3, 4, 5, 6, 7, 8, 9, 10:
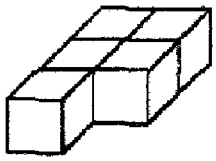
Figures 1, 2, 3, 4, 5, 6, 7, 8, 9, 10, 11:
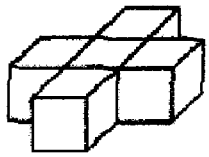
Figures 1, 2, 3, 4, 5, 6, 7, 8, 9, 10, 11, 12:
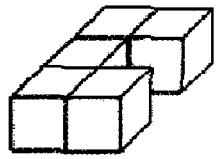

Another embodiment of the invention is shown in FIG. 6. The support base comprises a four-unit by six-unit rectangular bottom member. A four-unit by six-unit rectangular vertical back member is attached to one of the six-unit bottom member edges. Two vertical stairstep side walls are attached to the two four-unit bottom member edges as well as to the vertical edges of the back member. The side walls have a shape equivalent to a one-unit tall by four-unit wide foundation layer; a one-unit tall by three-unit wide layer above the foundation layer; a one-unit tall by two-unit wide layer above the three-unit wide layer; and a one-unit tall by one-unit wide layer at the top; all of the layers being aligned to form a vertical edge, thereby forming a stairstep side wall. A solution is shown in FIG. 7.

The tower containing embodiments described below may also comprise side walls, such as vertical side walls attached to the edges of the bottom member and equal in height to the towers, or the side walls may form a slidingly removable sleeve conforming to the shape of the puzzle, useful in keeping the pieces of an assembled puzzle in place. The slidingly removable sleeves may be removed in either a horizontal or vertical direction. The tower dimensions are described as length by width by height. The puzzles are solved by fitting the assembly pieces such that the final configuration has smooth surfaces aligned with the edges of a base bottom member and the top surface of the tower or towers. The total volume of the symmetrical figures formed is equal to the length of the bottom member times the width of the bottom member time the height of a tower. Subtracting the volume of the towers from the total volume gives a volume of sixty cubes, the volume of the pieces.

Figure 8A:
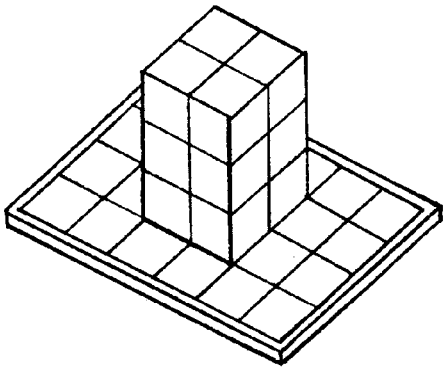
FIG. 8A shows a single-tower puzzle support base comprising a four-unit by six-unit bottom member and a centrally located two-unit by two-unit by three-unit tower.

An embodiment of the invention is shown in FIG. 8A. The support base comprises a four-unit by six-unit rectangular bottom member and a two-unit by two-unit by three-unit tower attached to the bottom member. The tower is centrally located on the bottom member, one-unit distant from each of the two six-unit bottom member edges and two-units distant from each of the four-unit bottom member edges. A solution is shown in FIG. 9A.

Figure 8B:
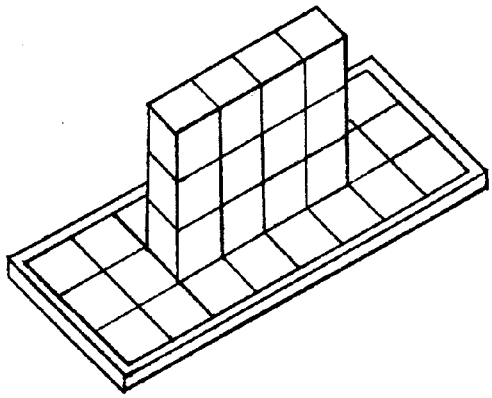
FIG. 8B shows a single-tower puzzle support base comprising a three-unit by eight-unit bottom member and a centrally located one-unit by four-unit by three-unit tower.

Another embodiment of the invention is shown in FIG. 8B. The support base comprises a three-unit by eight-unit rectangular bottom member and a one-unit by four-unit by three-unit tower attached to the bottom member. The tower is centrally located and aligned lengthwise on the bottom member; the four-unit sides of the tower are one unit distant from the eight-unit edges of the bottom member; and the one-unit sides of the tower are two units distant from the three-unit edges of the bottom member. A solution is shown in FIG. 9B.

Figure 8C:
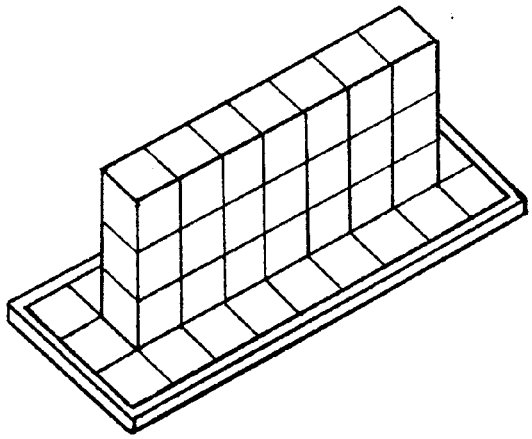
FIG. 8C shows a single-tower puzzle support base comprising a three-unit by nine-unit bottom member and a centrally located one-unit by seven-unit by three-unit tower.

Another embodiment of the invention is shown in FIG. 8C. The support base comprises a three-unit by nine-unit rectangular bottom member and a one-unit by seven-unit by three-unit tower attached to the bottom member. The tower is centrally located on the bottom member, each edge of the tower one unit distant from each of the corresponding edges of the bottom member. A solution is shown in FIG. 9C.

Another embodiment of the invention is shown in FIG. 10A. The support base has a polygonal bottom member and a tower; the bottom member has the shape of a five-unit by five-unit square with a one-unit square removed from each of the four corners, thereby forming a polygonal plus shape; the one-unit by one-unit by three-unit tower is located on the central square of the bottom member. A solution is shown in FIG. 10B.

Figure 11A:
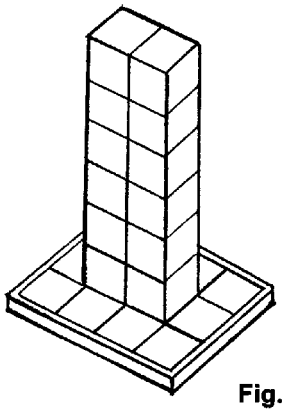
FIG. 11A shows a single-tower puzzle support base comprising a three-unit by four-unit bottom member and a centrally located one-unit by two-unit by six-unit tower.
Figure 12A:
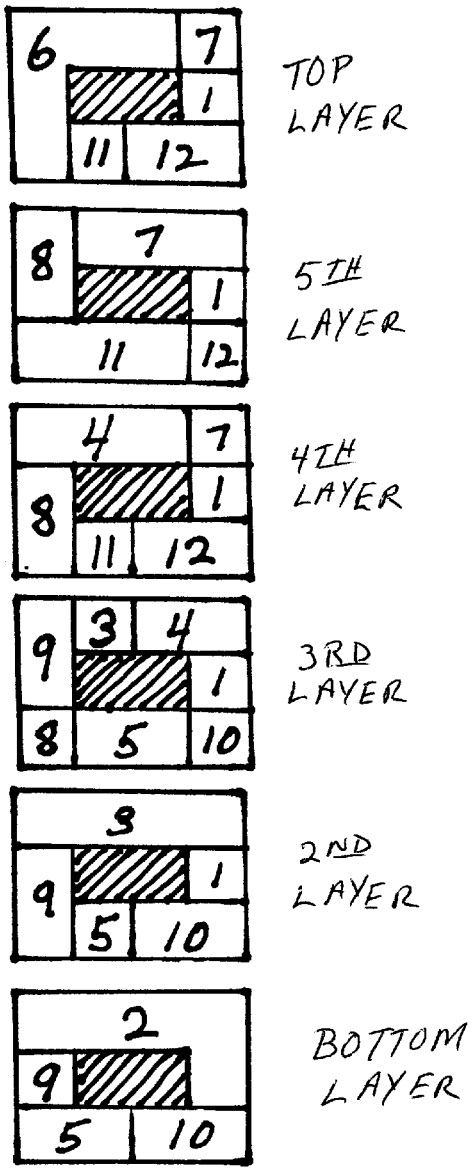
FIG. 12A shows a solution to a puzzle fitting the support base of FIG. 11A.

Another embodiment of the invention is shown in FIG. 11A The support base comprises a three-unit by four-unit rectangular bottom member and a one-unit by two-unit by six-unit tower attached to the base. The tower is centrally located on the base, one-unit distant from each of the four bottom member edges. A solution is shown in FIG. 12A.

Figure 11B:
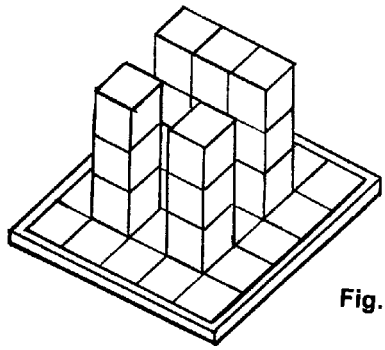
FIG. 11B shows a triple-tower puzzle support base comprising a five-unit by five-unit bottom member and three centrally located towers, two towers with dimensions one-unit by one-unit by three-units, and one tower with dimensions one-unit by three-units by three-units.
Figure 12B:
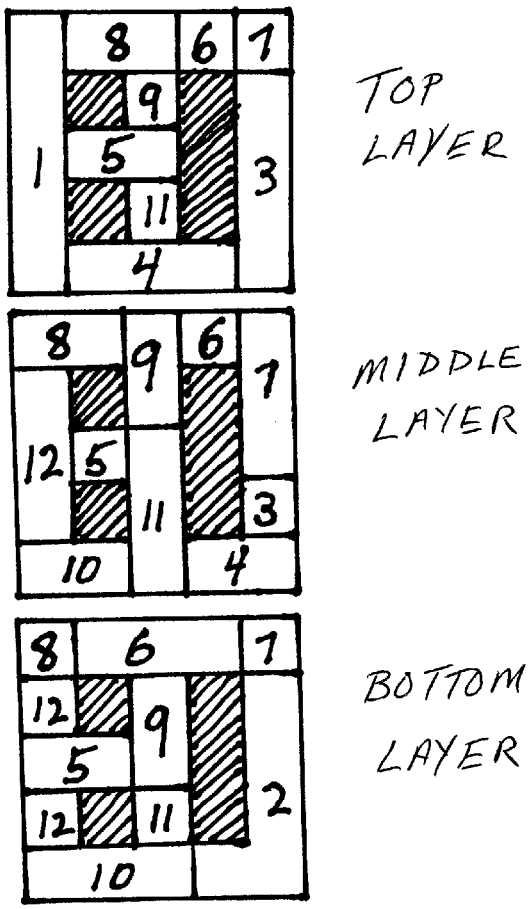
FIG. 12B shows a solution to a puzzle fitting the support base of FIG. 11B.

Another embodiment of the invention is shown in FIG. 11B. The support base comprises a five-unit by five-unit square bottom member and three towers. The first tower is a one-unit by three-unit by three-unit tower located one-unit from three of the bottom member edges, and three-units from the fourth edge. The two final towers are one-unit by one-unit by three-unit towers. Each tower is one-unit distant from two of the edges of the bottom member, one-unit distant from the first tower and one-unit distant from the remaining tower. A solution is shown in FIG. 12B.

Figure 11C:
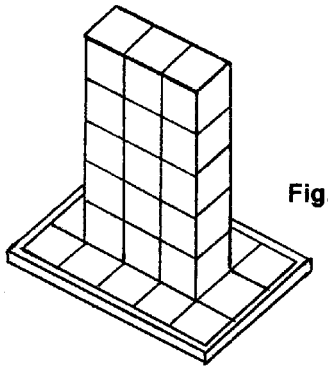
FIG. 11C shows a single-tower puzzle support base comprising a three-unit by five-unit bottom member and a centrally located one-unit by three-unit by five-unit tower.
Figure 13A:
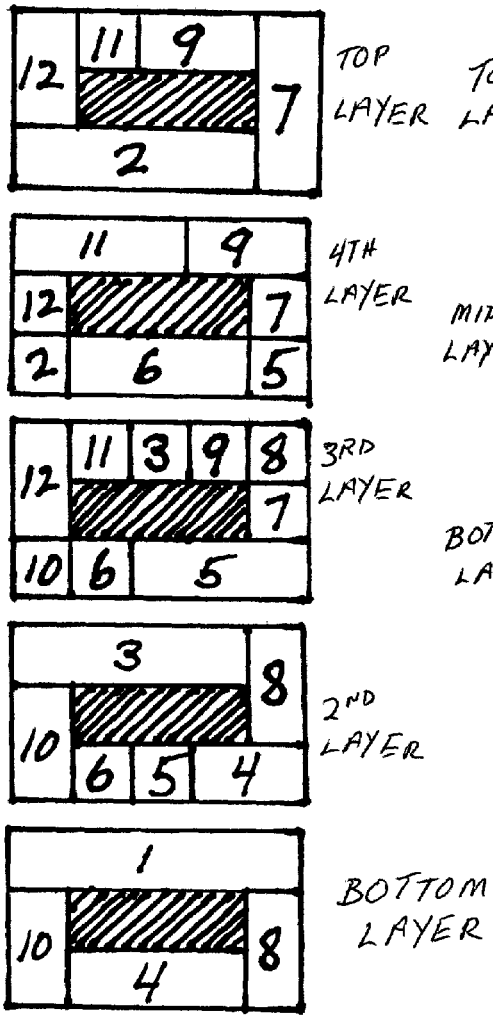
FIG. 13A shows a solution to a puzzle fitting the support base of FIG. 11C.

Another embodiment of the invention is shown in FIG. 11C The support base comprises a three-unit by five-unit rectangular bottom member and a one-unit by three-unit by five-unit tower attached to the base. The tower is centrally located on the base, one-unit distant from each of the four bottom member edges. A solution is shown in FIG. 13A.

Figure 11D:
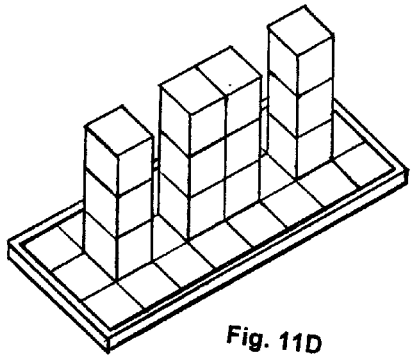
FIG. 11D shows a triple-tower puzzle support base comprising a three-unit by eight-unit bottom member, a one-unit by one-unit by three-unit tower, a one-unit by two-unit by three-unit tower, and a second one-unit by one-unit by three-unit tower.
Figure 13B:
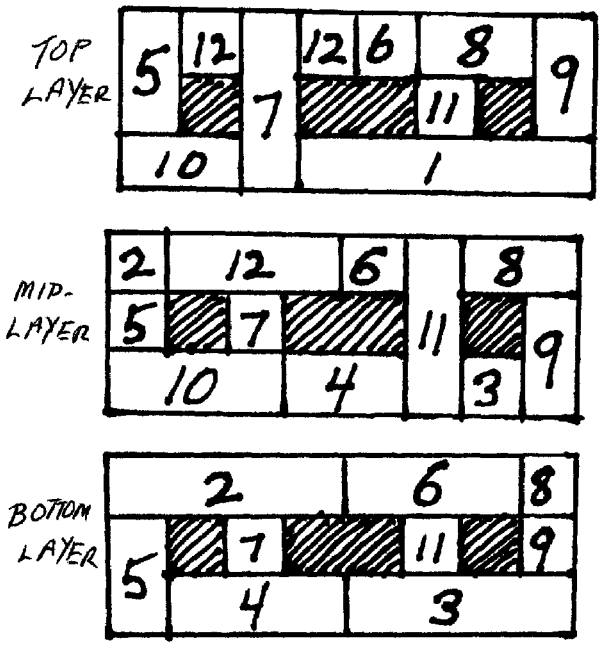
FIG. 13B shows a solution to a puzzle fitting the support base of FIG. 11D.

Another embodiment of the invention is shown in FIG. 11D. The support base comprises a three-unit by eight-unit rectangular bottom member with three towers attached to the bottom member. The first tower is a one-unit by one-unit by three-unit tower located one-unit distant from three of the edges of the bottom member. The second tower is a one-unit by two-unit by three-unit tower; the length of the tower aligned with the length of the bottom member of the support base and one unit distant from the first tower and one unit distant from the two eight-unit edges of the bottom member. The third tower is a one-unit by one-unit by three-unit tower located one-unit distant from the second tower and one-unit distant from three of the edges of the bottom member. A solution is shown in FIG. 13B.

Figure 11E:
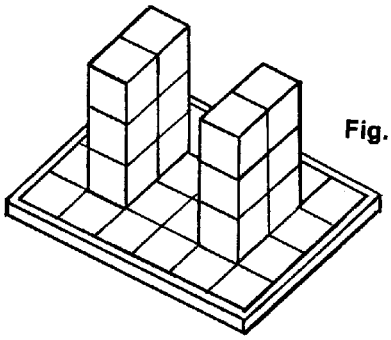
FIG. 11E shows a double-tower puzzle support base comprising a four-unit by six-unit bottom member, and two centrally located one-unit by two-unit by three-unit towers.
Figure 14A:
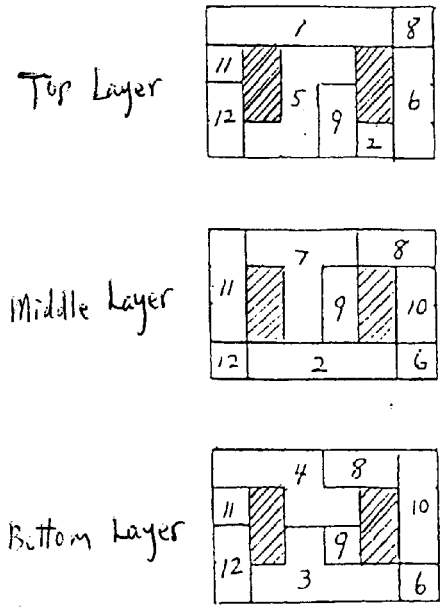
FIG. 14A shows a solution to a puzzle fitting the support base of FIG. 11E.

Another embodiment of the invention is shown in FIG. 11E. The support base comprises a four-unit by six-unit rectangular bottom member with two towers attached to the bottom member. The towers are one-unit by two-unit by three-unit towers, aligned parallel with the four-unit edges of the bottom member. Each tower is one-unit distant from three of the edges of the bottom member, and two-units distant from the other tower. A solution is shown in FIG. 14A.

Figure 11F:
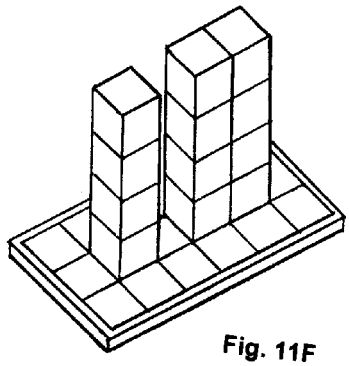
FIG. 11F shows a double tower puzzle support base comprising a three-unit by six-unit bottom member, a centrally located one-unit by one-unit by four-unit tower, and a centrally located one-unit by two-unit by four-unit tower.
Figure 14B:
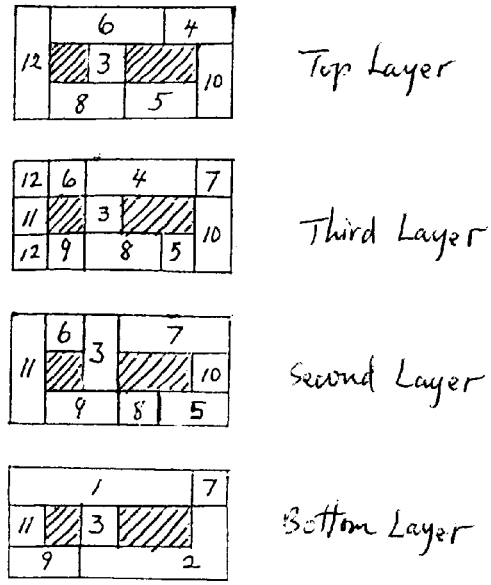
FIG. 14B shows a solution to a puzzle fitting the support base of FIG. 11F.
Figure 15A:
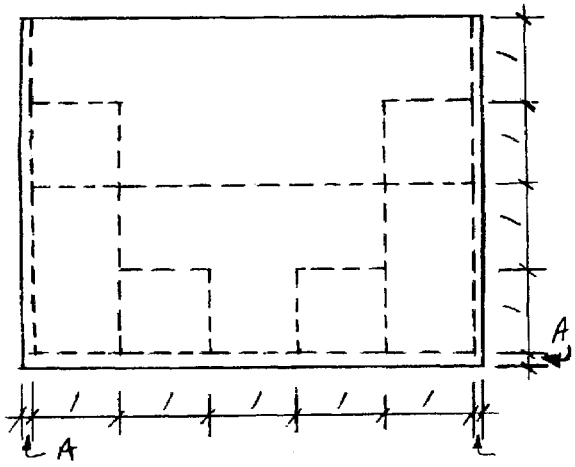
FIG. 15A shows a top view of a crenellated tower support base and side walls.
Figure 15B:
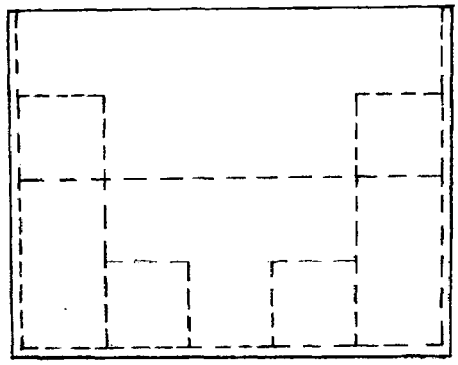
FIG. 15B shows a perspective view of a crenellated tower support base without side walls.
Figure 15C:
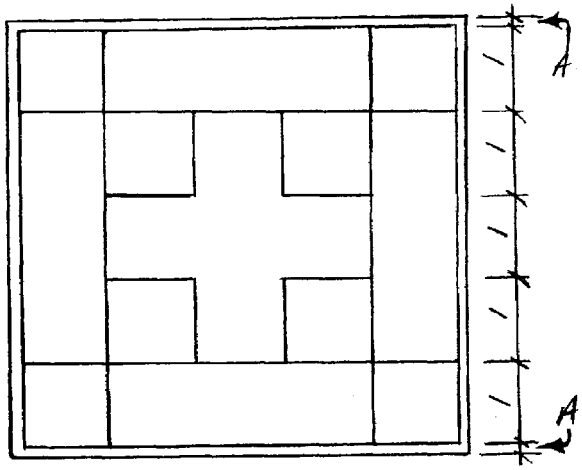
FIG. 15C shows a front view of a crenellated tower support base and side walls.
Figure 15D:
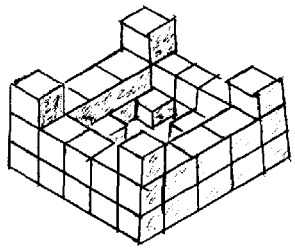
FIG. 15D shows a side view of a crenellated tower support base and side walls.
Figure 16A:
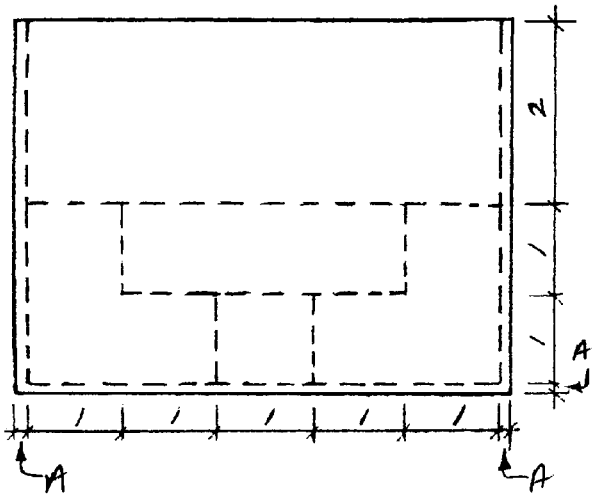
FIG. 16A shows a top view of a circumferential tower support base and side walls.
Figure 16B:
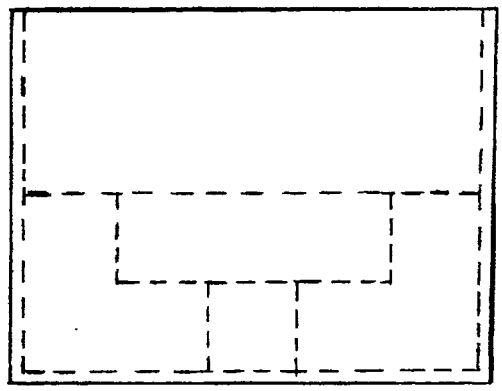
FIG. 16B shows a perspective view of a circumferential tower support base without side walls.
Figure 16C:
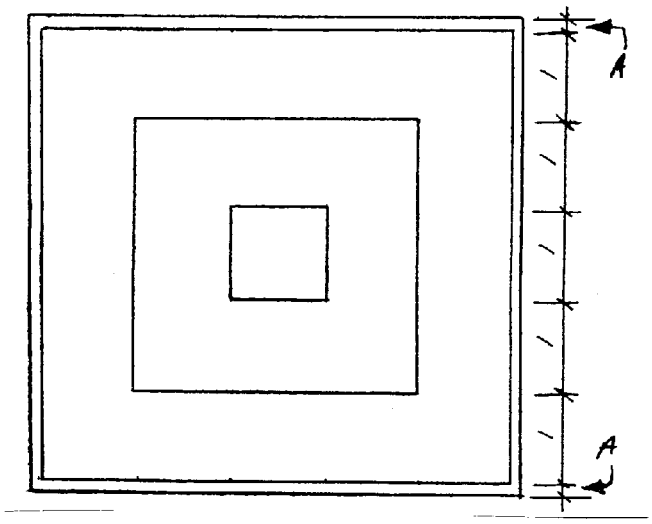
FIG. 16C shows a front view of a circumferential tower support base with side walls.
Figure 16D:
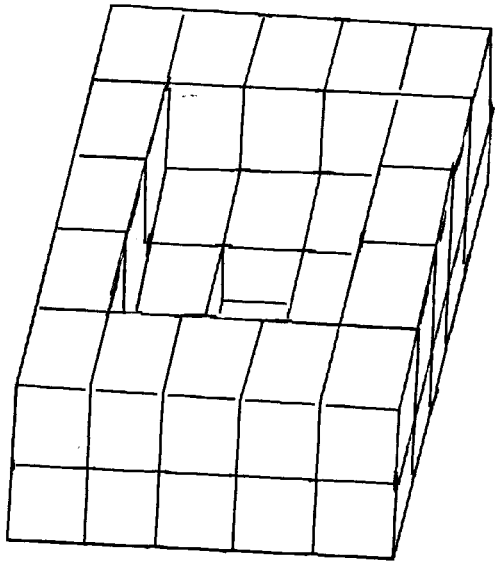
FIG. 16D shows a side view of a circumferential tower support base with side walls.
Figure 18:
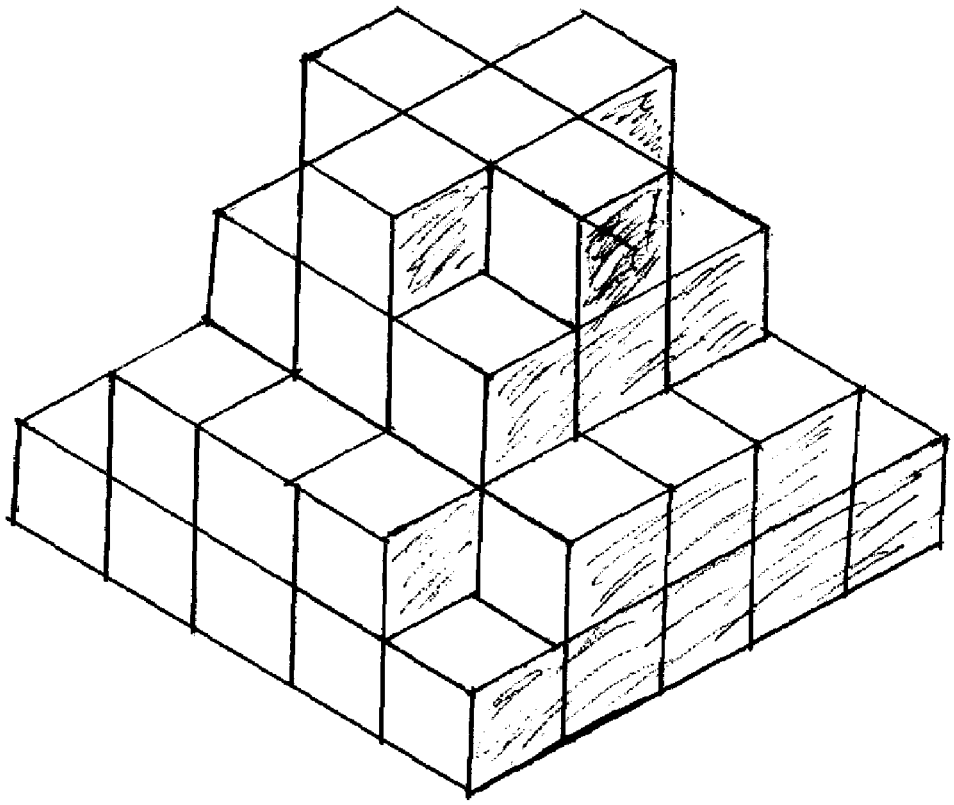
FIG. 18 is a structure formed by inverting the solved puzzle of FIG. 15 support base, followed by removal of the support base.
Figure 19:
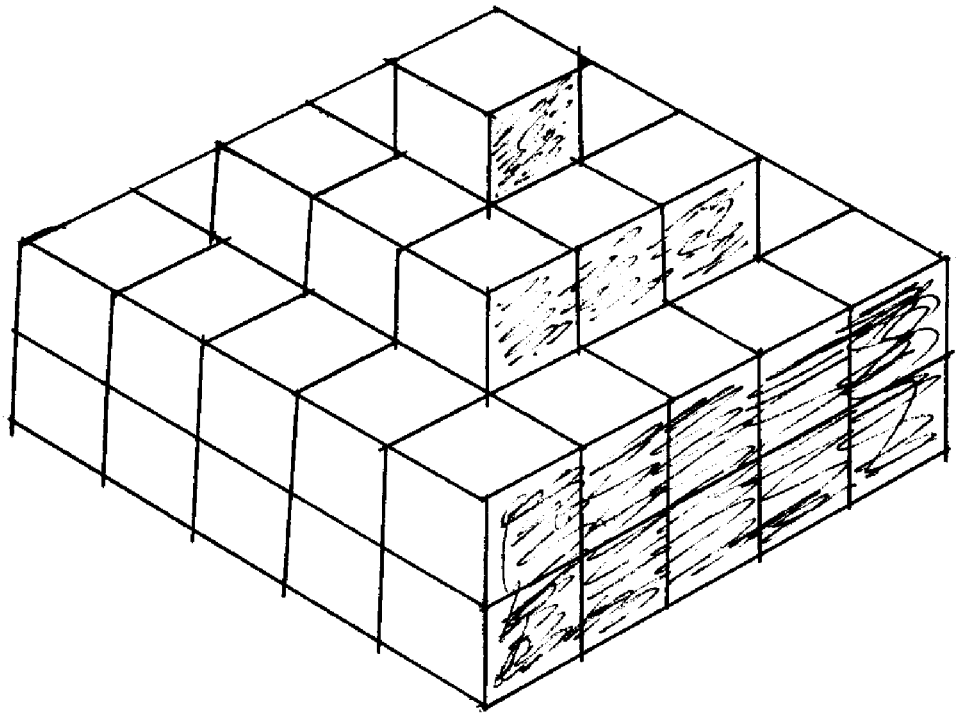
FIG. 19 is a structure formed by inverting the solved puzzle of FIG. 16 support base, followed by removal of the support base.

Another embodiment of the invention is shown in FIG. 11F. The support base comprises a three-unit by six-unit rectangular bottom member with two towers attached to the bottom member. The first tower is a one-unit by one-unit by four-unit tower located one unit distant from three of the edges of the bottom member. The second tower is a one-unit by two-unit by four-unit tower aligned with six-unit edge of the bottom member and located one-unit distant from three of the edges of the bottom member and one-unit distant from the first tower. A solution is shown in FIG. 14B.

In the following two embodiments of the invention the assembly pieces are stacked above the height of the towers. Fixed or slidingly removable side walls, taller than the towers, may be used with the support base. The volume of the final figures formed is equal to the length of the bottom member times the width of the bottom member times the height of the walls. Subtracting the volume occupied by the towers leaves the volume occupied by the assembly pieces, sixty cubes in these embodiments.

An embodiment of the invention is shown in FIG. 15, a crenellated tower. FIG. 15A shows a top view of the support base with side walls attached. FIG. 15B shows a perspective view of the support base without side walls. FIG. 15C shows a front view of the support base with side walls attached, and FIG. 15D shows a side view of the support base and side walls. The support base has a shape equivalent to a five-unit by five-unit square bottom member to which is attached a one-unit wide by two-unit high circumferential wall; a unit cube is attached to each of the four corners at the top of the circumferential wall; and a unit cube is attached to the bottom member and each of the four interior corners formed by the circumferential wall. The support base may further comprise vertical side walls, extending one unit in height above the tallest towers. The vertical side walls may be attached to the bottom member of the support base, or they may form a slidingly removable sleeve. A solution is shown in FIG. 17A.

Another embodiment of the invention is shown in FIG. 16, the circumferential tower. FIG. 16A shows a top view of the support base with side walls attached. FIG. 16B shows a perspective view of the support base without side walls. FIG. 16C shows a front view of the support base with side walls attached, and FIG. 16D shows a side view of the support base and side walls. The support base has a shape equivalent to a five-unit by five-unit rectangular bottom member to which is attached a one-unit wide by two-unit high circumferential wall; a second circumferential wall, one-unit in height is attached to the bottom member, as well as the interior of the first circumferential wall. The support base may further comprise vertical side walls, extending two units in height above the tallest circumferential tower. The vertical side walls may be attached to the bottom member of the support base, or they may form a slidingly removable sleeve. A solution is shown in FIG. 17B.

Each of the embodiments described may optionally include packaging and directions for using and solving the puzzles.

DEFINITIONS OF TERMS USED

A unit as used herein is equivalent to the length of an edge of a cube. A unit may be any convenient unit of length. A unit might be 1 cm, 2 cm, 1.2 in., 0.5 in., 1.6 in., 1.1 ft., or any length desired for fabricating the objects of the invention.

Cubes as used herein refer to identically sized cubes of unit dimension.

Squares as used herein refer to identically sized squares of unit dimension, the same unit dimension as used in cubes.

Facially attached or facially connecting as used herein means that the connecting faces of the cubes are joined along their edges. Facially attached as used herein also means that the face of a cube is joined to all four edges of a square.

Edge connected or edge attached as used herein. means that connecting sides of the squares are joined along an edge.

Polyomino as used herein refers to assembly pieces having shapes equivalent to a whole number of cubes facially attached to one another. As used herein polyomino also refers to a single cube polyomino.

Pentomino as used herein refers to polyomino pieces having shapes equivalent to five cubes facially attached to one another.

A sleeve or sleeve-type wall as used herein refers to a set of planar wall members whose edges are attached to one another so as to form a polygonal hollow tube or sleeve. A sleeve-type wall can slidingly enclose an assembled puzzle. A sleeve-type wall can be manipulated using either a horizontal or vertical motion with respect to the assembled puzzle.

A stairstep wall, or stairstep side as used herein is a vertical member, at least one side of which possesses a stairstep shape, the horizontal and vertical dimensions of the steps are the same size as the edge of a unit cube, and the side has an area equal to a whole number of squares.

A tower as used herein has a shape equivalent to a vertical assembly of at least one cube attached to a square portion of the bottom member of a support base. Towers have shapes equivalent to whole numbers of cubes.

A circumferential tower as used herein is a tower that forms a ring or square.

A circumferential wall as used herein is a contiguous wall enclosing an assembly puzzle.

A support base as used herein is an object consisting of a bottom member, zero or more towers, and zero or more walls. A support base is used to support the assembly pieces during puzzle assembly and to suggest the final shape of the completed puzzle.

Treasure-box shaped as used herein refers to a polygonal shape formed by a six-unit by six-unit square from which six individual unit squares have been removed as follows: three unit squares are removed from each of two diagonally opposite corners of the six by six square, the three unit squares being the corner square and the two squares adjoining the edges of the corner square. Colored as used herein refers to the visible coloration or markings of an object. The materials may be all the same color, or they may be colored differently. Assembly pieces may be uniform in color or individual cube portions may be colored differently, so as to form a pattern in a completed puzzle. Such patterns could include pictures, cube portions alternating in color to form a checkerboard pattern, cube portions alternating in color to form striped patterns, or other coloration patterns. In addition the faces of individual cube portions could display numbers, such that when assembled the numbers present on the cube portion faces add vertically, horizontally, and diagonally to form particular values. Colors may be a property of the materials, such as woods of differing colors (walnut, oak, maple), metals of differing colors (aluminum, copper, gold, silver), stone of differing colors (granite, pink marble, green marble, black marble, quartz), fabrics of different colors or patterns, or color may be a result of the application of a surface coating, such as paint or dye, to the material.

I claim:

1. An assembly puzzle comprising:

a three-dimensional, symmetrical figure consisting of interfitting assembly pieces and a support base;

the support base comprising a shape equivalent to:

a flat, horizontally-oriented, polygonal bottom member possessing an upper surface and edges;

the upper surface being divisible into a whole number of identically-sized, edge-connected squares;

the upper surface having an area;

at least one vertical tower having a height;

the tower being permanently facially attached to at least one square of the upper surface;

the assembly pieces and vertical tower having a shape equivalent to a whole number of identically-sized, facially-connected cubes;

the symmetrical figure being at least two cubes in thickness; and the volume of the symmetrical figure being defined by the area of the upper surface multiplied by the height of the tower;

wherein the volume of the symmetrical figure, minus the volume occupied by the tower, is substantially equal to sixty cubes;

wherein the assembly pieces have a shape equivalent to five facially connected cubes whose centers all lie in a single plane, the pieces being:

one piece having a shape equivalent to five adjacent cubes aligned in a row;

one piece having a shape equivalent to four cubes aligned in a row and a fifth cube connected to a side of an end cube in the row and the fifth cube being out of alignment with respect to the row;

one piece having a shape equivalent to four cubes in a row and a fifth cube connected to a side of an intermediate cube in the row;

one piece having a Z shape;

one piece having an S shape;

one piece having a V shape;

one piece having a I shape;

one piece having a W shape;

one piece having a shape equivalent to three cubes in a row with a fourth cube connected to a side of an intermediate cube in the row and a fifth cube connected to an opposite side of an end cube in the row which is opposite from the fourth cube;

one piece having a shape equivalent to four cubes that form a square and a fifth connected to one side of the four cube square;

one piece having a cross shape;

one piece having a U shape.

2. The puzzle of claim 1 further comprising vertical side walls substantially equal in height to the tower.

3. The puzzle of claim 2 wherein the side walls form a slidingly removable sleeve.

4. The puzzle of claim 2 wherein the side walls are attached to the edges of the bottom member.

5. The puzzle of claim 1 further comprising colored assembly pieces.

* * * * *